US007197900B2

(12) United States Patent
Lee

(10) Patent No.: US 7,197,900 B2
(45) Date of Patent: Apr. 3, 2007

(54) WASHING MACHINE

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 544 days.

(21) Appl. No.: 10/716,436

(22) Filed: Nov. 20, 2003

(65) Prior Publication Data

US 2004/0099021 A1 May 27, 2004

(30) Foreign Application Priority Data

Nov. 26, 2002 (KR) ..... 10-2002-0073854

(51) Int. Cl.
*D06F 33/02* (2006.01)

(52) U.S. Cl. ..... 68/12.06; 68/12.27; 68/23.1

(58) Field of Classification Search ..... 68/12.01, 68/12.06, 12.19, 12.27, 23.1
See application file for complete search history.

(56) References Cited

U.S. PATENT DOCUMENTS 5,315,847 A * 5/1994 Takeda et al. ..... 68/12.02
5,850,746 A * 12/1998 Lee ..... 68/12.06
6,292,966 B1 * 9/2001 Lim et al. ..... 8/158
6,336,348 B1 * 1/2002 Lee et al. ..... 68/12.27
6,640,637 B2 * 11/2003 Baek ..... 73/652

FOREIGN PATENT DOCUMENTS

JP 03077584 A * 4/1991

* cited by examiner

*Primary Examiner*—Joseph L. Perrin
(74) *Attorney, Agent, or Firm*—McKenna, Long & Aldridge

(57) ABSTRACT

A washing machine having a dual-purpose sensor capable of detecting a degree of vibration generated during a dewatering step as well as measuring detergent levels present in the water. The washing machine having a sensor unit installed with respect to an outer tub for holding water. The washing machine includes a microcomputer having an input port receiving an applied voltage, the input port electrically connected to a supply voltage; first and second electrodes, installed so as to be submerged in the water of the outer tub, wherein the first electrode is electrically connected to the supply voltage and the second electrode is electrically connected to ground, to thereby generate the applied voltage for input to the input port of the microcomputer; a spherical conductor disposed adjacent to the electrodes; and a support for supporting the spherical conductor.

3 Claims, 4 Drawing Sheets

WASHING MACHINE

This application claims the benefit of Korean Application No. 10-2002-0073854 filed on Nov. 26, 2002, which is hereby incorporated by reference.

BACKGROUND OF THE INVENTION

1. Field of the Invention

The present invention relates to a washing machine, and more particularly, to a washing machine provided with a dual-purpose sensor for detecting a degree of vibration generated during a dewatering step and for measuring detergent levels present in the water.

2. Discussion of the Related Art

Generally speaking, a washing machine is an apparatus for removing dirt from laundry through such steps as washing, rinsing, and dewatering in accordance with a program stored in a microcomputer. Typically, a variety of operational features are provided using a plurality of sensors and detectors for inputting status signals to the microcomputer, so that the washing machine may be controlled as desired.

Referring to FIGS. 1 and 2, a washing machine according to a related art is comprised of a body 1 having a door 2 on a top of the body; an outer tub 5, installed inside the body, for holding water; an inner tub (dewatering tub) 6, installed inside the outer tub, having a multitude of perforations formed in a circumferential surface thereof to perform a dewatering step through a centrifugal force generated by the drive unit rotating the inner tub at high speed; a pulsator 7, installed in the bottom of the inner tub, receiving the drive force of a drive unit consisting of a motor 3 and a clutch 4, to agitate the water during a washing step; a drain pump 8 for draining the water; a microcomputer 10 for controlling the overall system; and a sensor 9 provided with a pair of electrodes 9*a* and 9*b* installed with respect to the outer tub for detecting the level of a detergent present in water within the outer tub. The first electrode 9*a* is connected to a supply voltage (Vcc), which is connected to an input port of the microcomputer 10 via a pull-up resistor, and the second electrode 9*b* is connected to ground. Though not specifically shown, the installation of the first and second electrodes 9*a* and 9*b*, which are separated by a predetermined distance, is such that both electrodes are submerged in water filling the outer tub 5.

In performing a washing step using the above-constructed washing machine, laundry is placed in the inner tub 6, which has an open top through which the laundry is passed via the door 2 of the body 1 and an open top of the outer tub 5. Then, water is supplied to the outer tub 5 through a water supply valve (not shown) after placing laundry in the inner tub 6. The outer tub is filled to a predetermined level, and detergent is added to the water. The pulsator 7 agitates the water, generating a roiling current to cause friction with the laundry and perform a washing step. Upon completion of the washing step, the drain pump 8 is actuated to drain the majority of the water, after which the inner tub 6 is rotated at high speed, thus using centrifugal force to remove the laundry's remaining water content.

In the washing step, once the water flows in the inner tub 6, the first and second electrodes 9*a* and 9*b* are electrically connected to each other so that the input port of the microcomputer 10 is grounded through the water and detergent, which is a contaminant. The detergent content of the water creates a resistance according to known rates, so that the microcomputer 10 can measure the amount of detergent present in the water. Namely, as the amount of the detergent increases, the resistance between the first and second electrodes 9*a* and 9*b* increases. The thus varying voltage applied to the input port of the microcomputer 10 is detected to measure the detergent level.

In providing a washing machine with a variety of operational features, it is desirable to impart the washing machine's sensors and detectors with maximum versatility. In the above washing machine according to the related art, however, the sensor 9 is an electrode-type sensor that measures the level of detergent content in the water, using a detected voltage across the first and second electrodes 9*a* and 9*b*, but is unable to play the role of another sensor.

SUMMARY OF THE INVENTION

Accordingly, the present invention is directed to a washing machine that substantially obviates one or more of the problems due to limitations and disadvantages of the related art.

An object of the present invention, which has been devised to solve the foregoing problem, lies in providing a washing machine having a dual-purpose sensor capable of detecting a degree of vibration generated during a dewatering step as well as measuring detergent levels present in the water.

Additional features and advantages of the invention will be set forth in the is description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine having a sensor unit installed with respect to an outer tub for holding water. The washing machine comprises a microcomputer having an input port receiving an applied voltage, the input port electrically connected to a supply voltage; first and second electrodes, installed so as to be submerged in the water of the outer tub, the first electrode electrically connected to the supply voltage and the second electrode electrically connected to ground, to thereby generate the applied voltage for input to the input port of the microcomputer; a spherical conductor disposed adjacent to the electrodes; and support means for supporting the spherical conductor. The first and second electrodes are installed such that a predetermined gap is maintained between the electrodes, to measure a contaminant in the water of the outer tub.

According to the present invention, an electrical short is created between the electrodes by a displacement of the spherical conductor when a state of imbalance exists in the washing machine.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
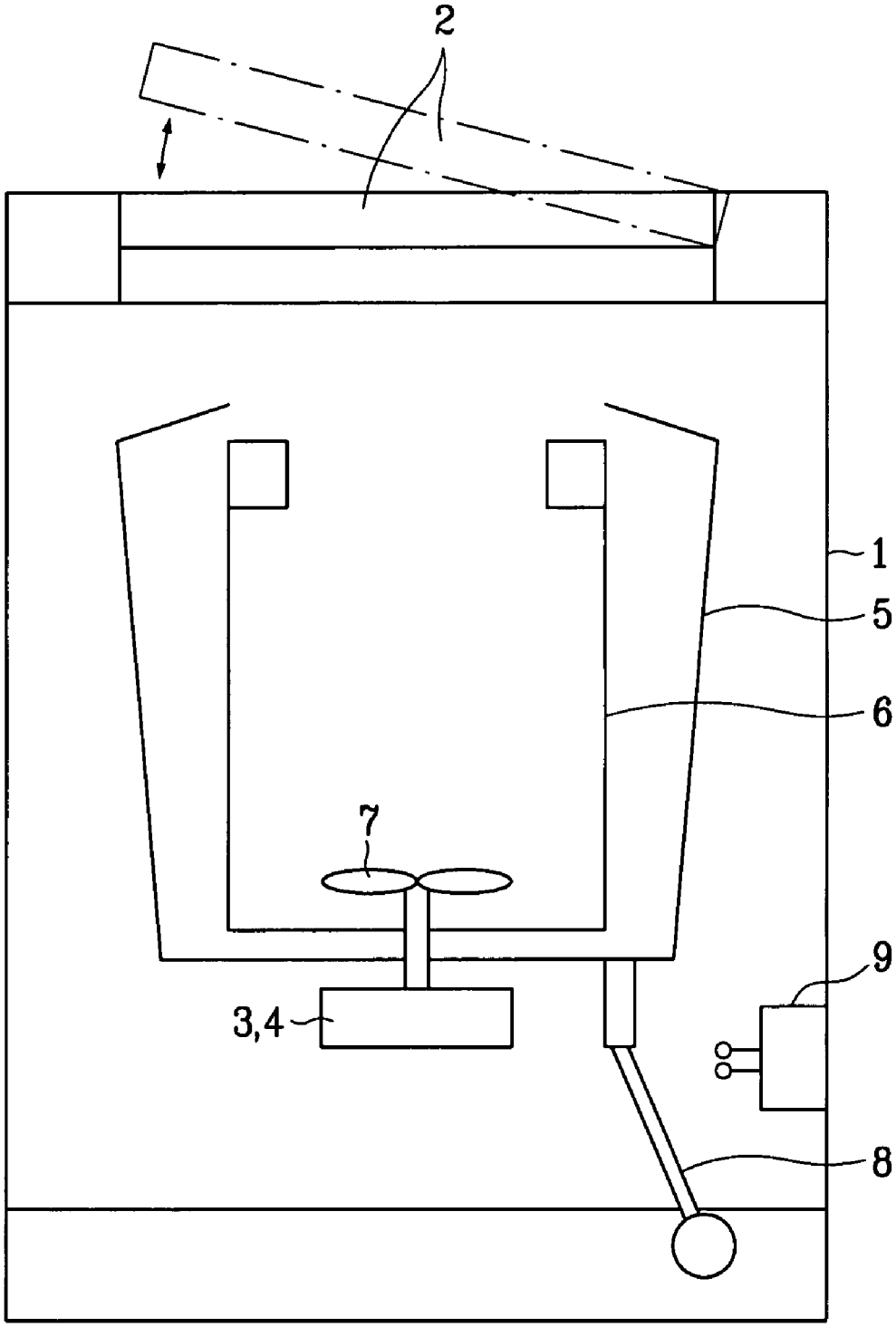
FIG. 1 Related Art
FIG. 1 is a schematic diagram of a washing machine according to a related art.
Figure 2:
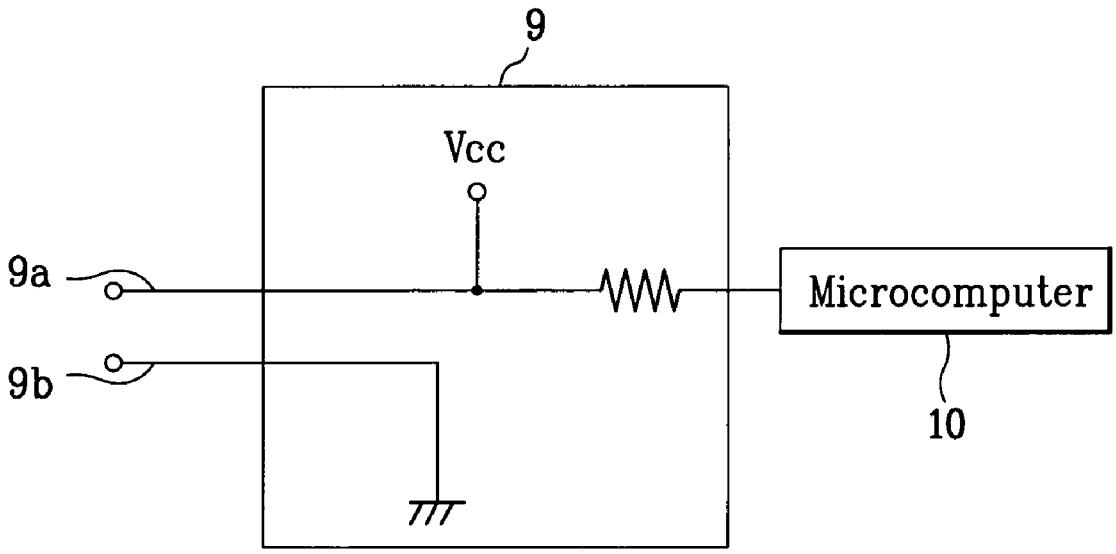
FIG. 2 Related Art
FIG. 2 is a schematic diagram showing a connection between an electrode sensor of the washing machine of FIG. 1 and a microcomputer.
Figure 3:
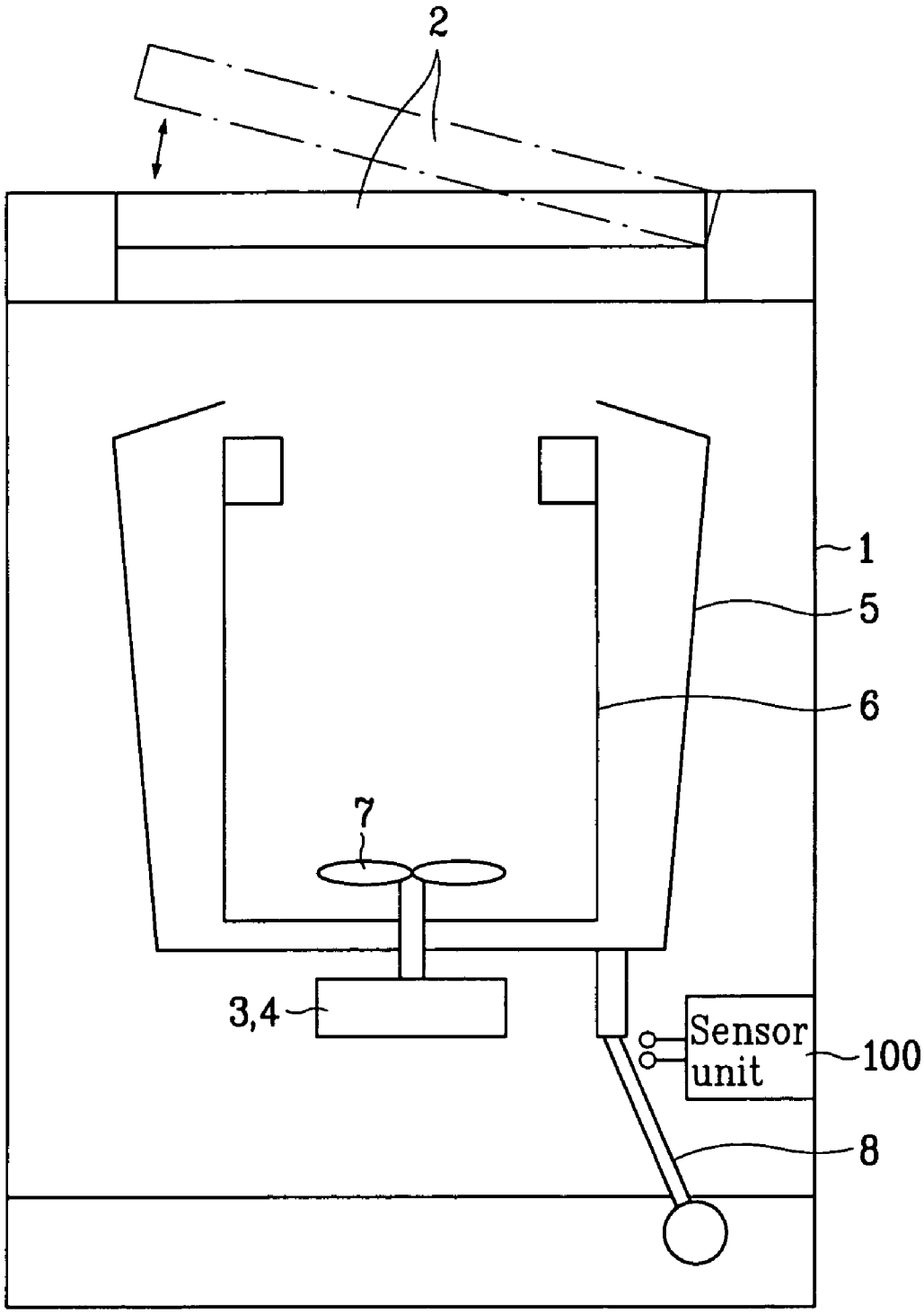
FIG. 3 is a diagram of a washing machine, having a sensor unit, according to the present invention.

FIG. 3 illustrates a washing machine having a sensor unit according to the present invention. Operational states of the sensor unit are illustrated in FIGS. 4 and 5.

Referring to FIG. 3, a washing machine according to a preferred embodiment of the present invention is comprised of a body 1 having a door 2 on a top of the body; an outer tub 5, installed inside the body, for holding water; an inner tub (dewatering tub) 6, installed inside the outer tub, having a multitude of perforations formed in a circumferential surface thereof to perform a dewatering step through a centrifugal force generated by the drive unit rotating the inner tub at high speed; a pulsator 7, installed in the bottom of the inner tub, receiving the drive force of a drive unit consisting of a motor 3 and a clutch 4, to agitate the water during a washing step; a drain pump 8 for draining the water; and a microcomputer 10 for controlling the overall system. The above elements of the washing machine of the present invention are equivalent to corresponding elements of the related art.

The washing machine according to the present invention further comprises a sensor unit 100 including an electrode-type sensor. The sensor unit 100 is provided with a pair of electrodes 20 and 30 installed with respect to the outer tub 5. The first electrode 20 is connected to a supply voltage (Vcc), which is directly connected to an input port of the microcomputer 60, and the second electrode 30 is connected to ground (Vss). Though not specifically shown, the installation of the first and second electrodes 20 and 30, which are separated by a predetermined distance, is such that both electrodes are submerged in water filling the outer tub 5. In addition to detecting the level of a detergent present in water within the outer tub 5, the sensor unit 100 also detects a state of imbalance due to excessive shaking or vibration occurring during the dewatering step.

Figure 4:
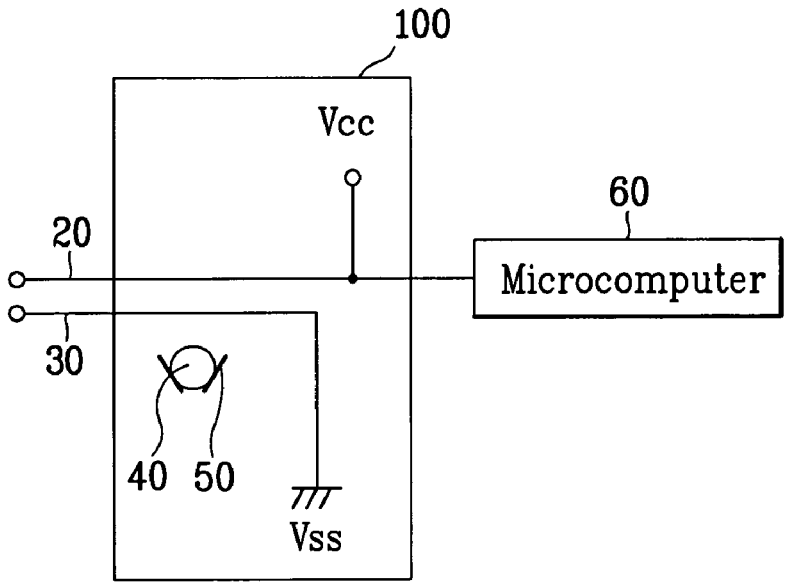
FIGS. 4 and 5 are block diagrams of the sensor unit of FIG. 3 and a microcomputer, respectively illustrating operational states of the sensor unit.
Figure 5:
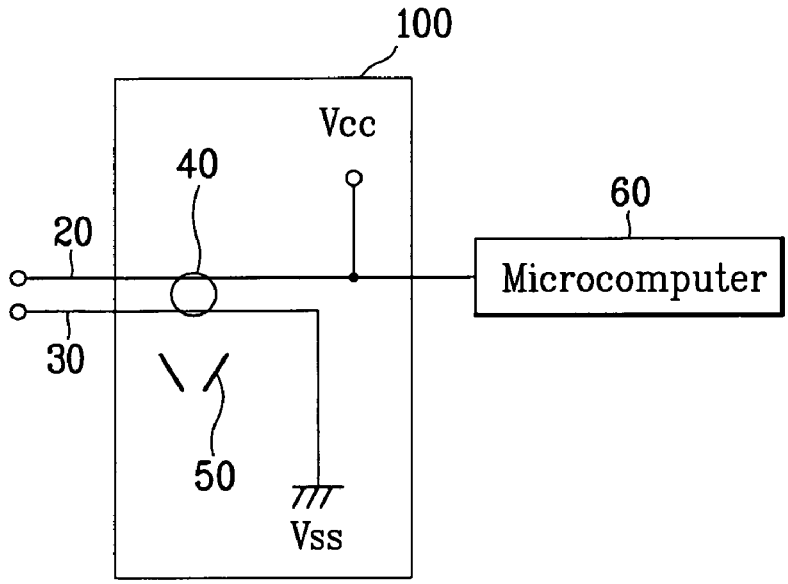

Referring to FIG. 4, the sensor unit 100 is provided with a spherical conductor 40 disposed adjacent the first and second electrodes 20 and 30, using a support means 50 having opposing sides for supporting the spherical conductor. The opposing sides of the support means 50 are inclined at a predetermined angle and the spherical conductor 40 rests within the predetermined angle.

To determine the level of detergent present in the water in the outer tub 5 during the washing step, an electrical connection existing between the first and second electrodes 20 and 30, via the water and detergent within the water, is detected by measuring at the input port of the microcomputer 60 the varying an input voltage applied thereto. If the level of detergent is low, the applied input voltage to the microcomputer 60 is relatively low, but greater than zero, and increases as the detergent level increases since a resistance between the first and second electrodes 20 and 30 is increased by the presence of higher levels of detergent.

Meanwhile, the spherical conductor 40, which rests within the support means 50 while the washing machine is in a normal (balanced) state as shown in FIG. 4, is displaced by a state of imbalance as shown in FIG. 5. In becoming thus displaced, the spherical conductor 40 creates a short circuit between the first and second electrodes 20 and 30, thereby bypassing the varying input voltage based on detergent level. That is, if a state of imbalance due to excessive levels of shaking or vibration exists when the washing machine of the present invention performs a dewatering step, the sensor unit 100 detects a short circuit and inputs a 0V signal to the input port of the microcomputer 60, to initiate an error message and a corresponding error state discontinuing the dewatering step. On the other hand, if there is no such imbalance, the applied voltage input to the microcomputer 60 is determined solely by the level of detergent present in the water.

Accordingly, the above-described sensor unit 100 is a dual-purpose sensor of an electrode type, simultaneously determining a detergent level and a state of imbalance due to excessive shaking or vibration during a dewatering step.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine having a sensor unit installed with respect to an outer tub for holding water, the washing machine comprising:

a microcomputer having an input port receiving an applied voltage, the input port electrically connected to a supply voltage;

first and second electrodes, installed so as to be submerged in the water of the outer tub, wherein said first electrode is electrically connected to the supply voltage and said second electrode is electrically connected to ground, to thereby generate the applied voltage for input to the input port of said microcomputer;

a spherical conductor disposed adjacent to said electrodes;

support means for supporting said spherical conductor;

wherein an electrical short is created between said electrodes by said spherical conductor displaced when a state of imbalance exists in the washing machine.

2. The washing machine as claimed in claim 1, wherein said first and second electrodes are installed such that a predetermined gap is maintained between said electrodes, to measure a contaminant in the water of the outer tub.

3. The washing machine as claimed in claim 1, wherein said support means has opposing sides for supporting said spherical conductor, the opposing sides being inclined at a predetermined angle, and wherein said spherical conductor rests within said support means while the washing machine is in a balanced state and is displaced by a state of imbalance.

* * * * *